United States Patent [19]

Wright

[11] 3,937,364

[45] Feb. 10, 1976

[54] FOAM DISPENSING DEVICE

[76] Inventor: Hershel Earl Wright, 12 Eight Drive, Decatur, Ill. 62521

[22] Filed: Apr. 3, 1975

[21] Appl. No.: 564,701

[52] U.S. Cl. ..... 222/190; 222/211; 239/343

[51] Int. Cl.[2] ..... B65D 37/00

[58] Field of Search ..... 222/190, 189, 211, 402.19; 239/343

[56] References Cited

UNITED STATES PATENTS

| | | | |
|---|---|---|---|
| 3,010,613 | 11/1961 | Stossel | 222/190 |
| 3,422,993 | 1/1969 | Boehm et al. | 222/190 |
| 3,428,222 | 2/1969 | Wright | 222/190 X |
| 3,572,590 | 3/1971 | Malone | 239/327 |

*Primary Examiner*—Allen N. Knowles
*Assistant Examiner*—Hadd S. Lane
*Attorney, Agent, or Firm*—Cohn, Powell & Hind

[57] ABSTRACT

A foam dispensing device having a foaming member and valve system in a flexible container designed to produce a quality foam when the container is pressurized regardless of the position of the container.

8 Claims, 3 Drawing Figures

Fig. I
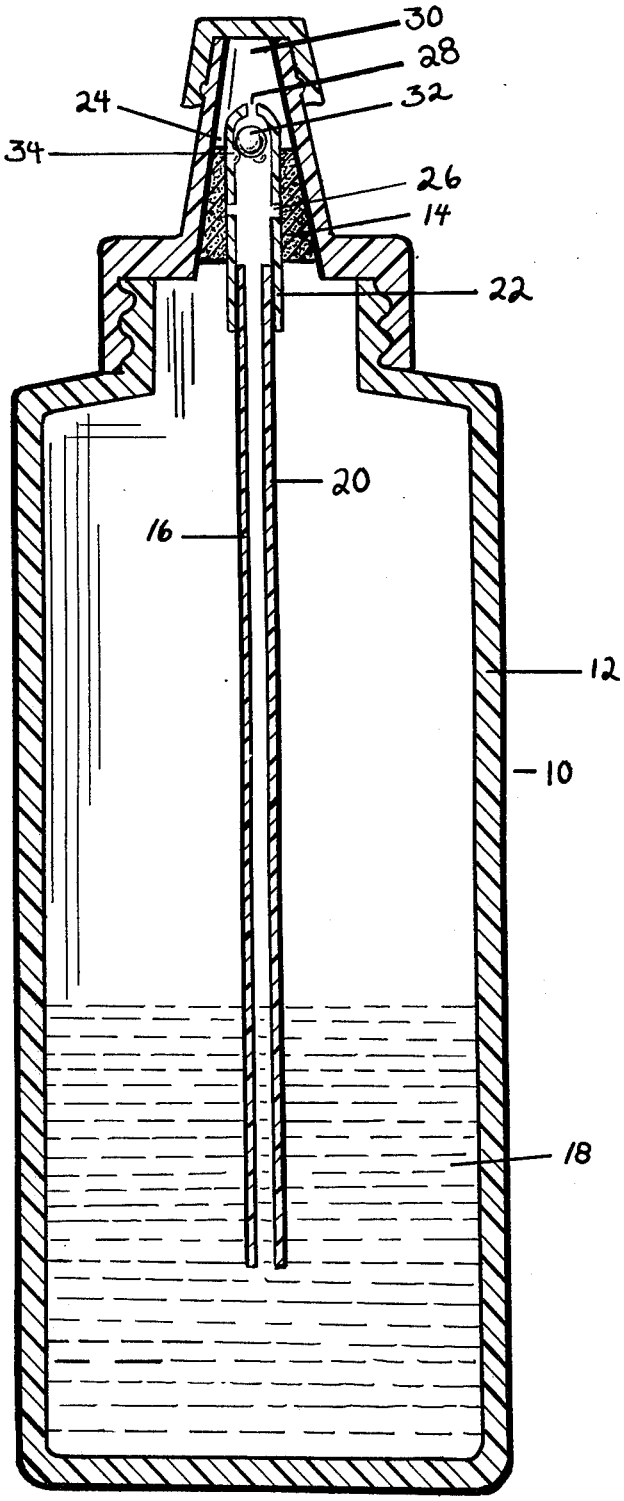

Fig. II
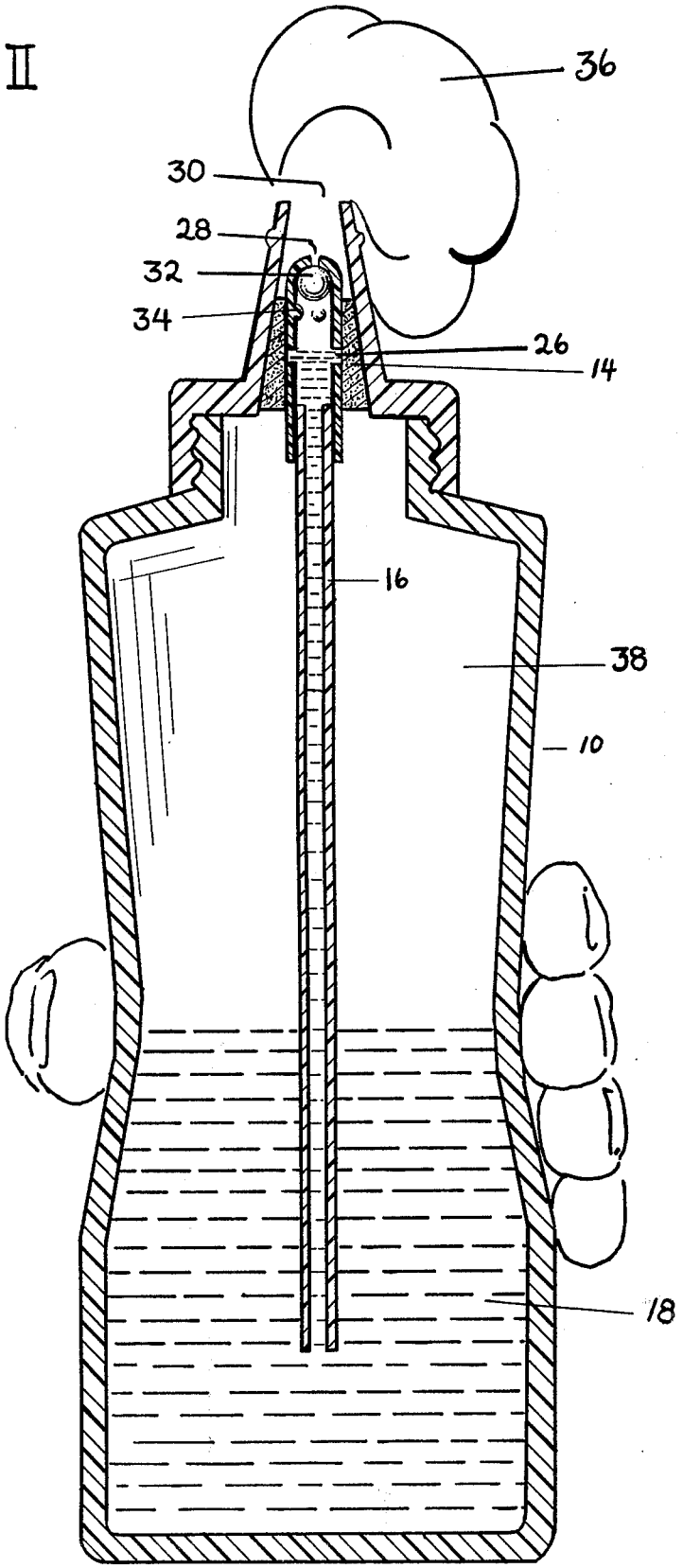

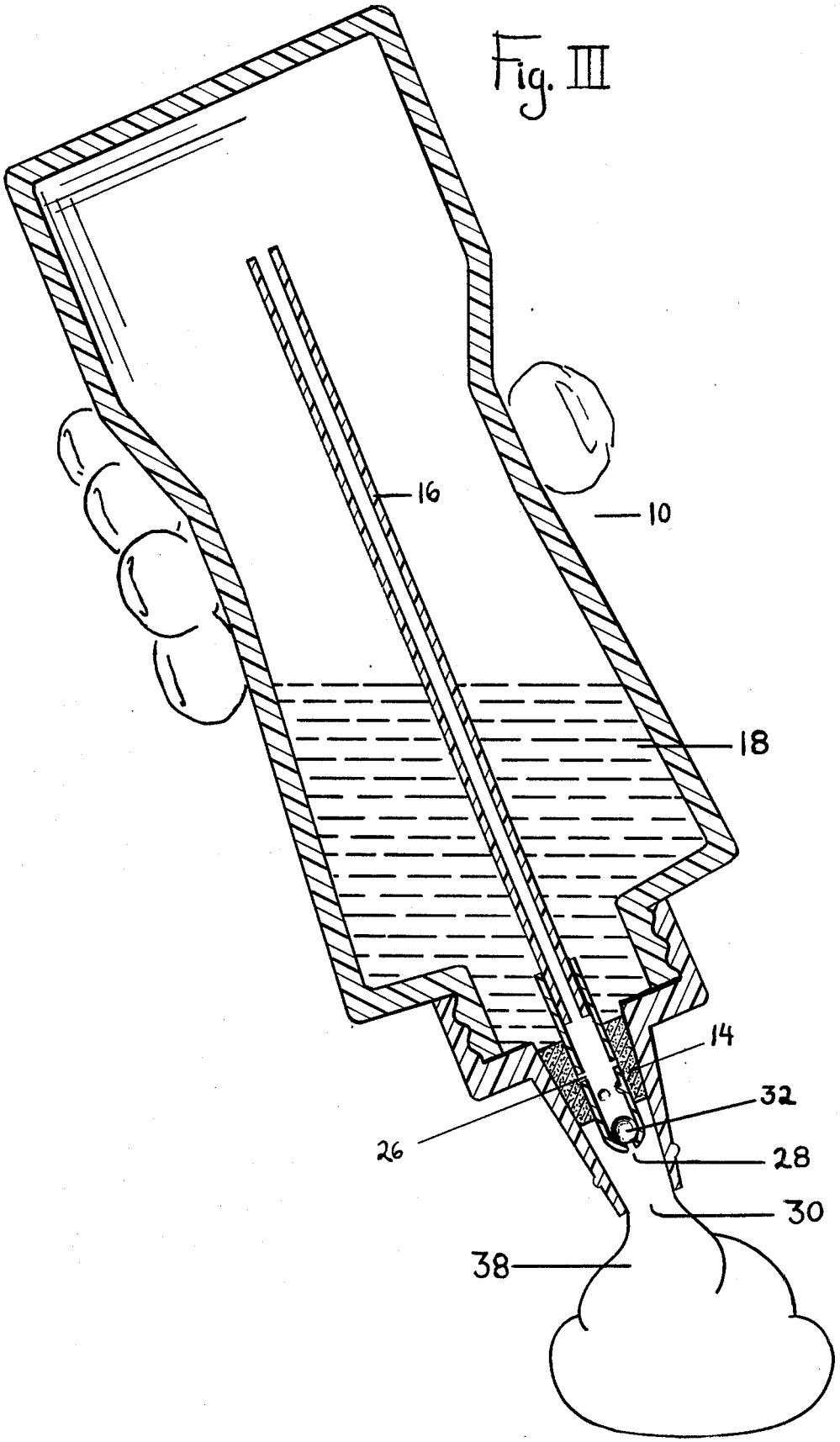
Fig. III
16
10
18
14
32
26
28
30
38

FOAM DISPENSING DEVICE

BACKGROUND OF THE INVENTION

Recent trends in the merchandising of consumer goods have indicated the need for dispensing devices capable of dispensing cleaning and waxing products, cosmetics and toiletries and food stuffs. Many of these consumer products adapt themselves to application in the form of a foam through a convenient hand dispensing device. Such dispensing devices must be economical to manufacture and efficient in operation to provide an advantage to the consumer over previous packaging techniques. The advent of self-contained pressurized dispensing devices has reduced the time required to produce foam but has introduced the requirement for a container strong enough to withstand the rather high internal pressures, thereby adding substantially to the manufacturing costs of such dispensing devices. In addition, such pressurized dispensing devices have the disadvantage that the gas used in effecting the formation of foam and discharge thereof does not replenish itself, thus limiting the useful life of the dispensing device.

As a result of the problems associated with pressurized dispensing devices, several types of foaming devices using flexible or plastic containers, relying on manual pressure, were developed. Unfortunately most, if not all of the more efficient devices, would work in only one position, generally upright. Consequently, there is a great need for a foaming device which can be used in any position and which is operated or pressurized manually.

SUMMARY OF THE INVENTION

The present invention relates generally to foaming devices and more specifically to manually operated foaming devices which can be used in any position.

Accordingly, it is a primary object of this invention to provide a foaming device which can be operated manually in any position.

It is another object of this invention to provide a foaming device which will produce a uniform foam on consecutive operations.

It is a further object of this invention to provide a manually operable foaming device having a rapid container recovery.

It is another object of this invention to provide a manually pressure-operated foaming device having a valving system which will permit the production of a uniform foam regardless of the position of the container.

Further objects and advantages of my invention, together with the organization and manner of operation thereof may best be understood by reference to the following description of the preferred embodiment of the invention when taken in conjunction with the accompanying drawings, wherein like reference numerals identify like elements through the several views.

BRIEF DESCRIPTION OF THE DRAWINGS

FIG. 1 is a longitudinal sectional view of the preferred foam dispensing device constructed in accordance with the present invention;

FIG. 2 is the container of FIG. 1 after being squeezed while upright; and

FIG. 3 is the container of FIG. 1 after being squeezed while in an inverted position.

DESCRIPTION OF THE PREFERRED EMBODIMENT

Referring to the drawings and more particularly FIG. 1, there is schematically shown a foaming device 10 comprising a flexible container 12, a porous member 14, a conduit 16, one end of which extends into a foamable solution 18. The opposite end of the conduit 16 extends through the porous member 14. In the embodiment shown the conduit is constructed in two sections 20 and 22 for convenience of assembly but a singularly constructed conduit would perform equally well.

The portion of the conduit 16 extending through the porous member 14 is provided with at least one aperture 26 opening into the porous member 14, a second aperture 28 opening into the discharge area 30 of the container 12 and valve system 24 including in this instance a ballcheck 32, and a supporting shelf comprising a series of projections 34 extending around the inside of conduit 16 designed to control the flow of fluid whether air or foamable solution through either aperture 26 or aperture 28.

The operation of the foaming device 10 can best be illustrated by reference to FIGS. 2 and 3. In FIG. 2 the foaming device is shown in the upright position. Pressurizing container 10 by manually squeezing the container forces the foamable liquid up through conduit 16 which in turn forces ballcheck 32 upwardly closing aperture 28. As a result, the foamable solution 18 is directed through aperture 26 into the porous member 14. At the same time the pressure within the container forces air to flow from the upper portion of the container 36 into the porous member 14 mixing with the foamable solution 18 entering from aperture 26 producing a foam 38 which exits from the discharge area 30. Upon release of manual pressure, i.e., removing or relaxing the fingers, the ballcheck 32 returns to rest on projections 34 allowing air to re-enter the container through the aperture 28, which constitutes an air reentry opening, and around the ballcheck and projections resulting in a rather rapid restoring of the original shape of the container.

FIG. 3 illustrates the foaming device 10 in an inverted position. A transition has occurred which changes the flow patterns. More specifically the end of the conduit 16 which formerly extended into the foamable solution 18 as described and shown in FIG. 2 now extends into the air space above the solution. The porous member 14 which was formerly in contact with the air space above the foamable solution 18 is now directly in contact with the foamable solution. In operation, manually squeezing container 10 now forces air along conduit 16. Ballcheck 32 drops to close aperture 28 resulting in the air being directed through aperture 26 mixing with foamable solution 18 being forced into the porous member 14 producing a foam 38 which discharges through discharge area 30. Thus, although the flow paths have changed by inverting the container 10, the net result is the same, that is the mixing of air and foam solution under pressure within the porous member 14 to produce a uniform foam discharging from the container regardless of container position during operation.

The valve system required is one that will close the aperture of the conduit which leads to the container discharge when the container is pressurized regardless of container position thereby directing the fluid in the conduit, whether foamable solution or air, through the aperture in the porous member. In addition the valve system must operate to provide a rapid air return to restore the shape of the container. The preferred system is a ballcheck operating in manner shown and described but it is obvious that any valving means or system which will function in the manner described is within the scope of the present invention. The ballcheck has the added advantage of activating when the container is merely inverted.

The porous member can be any material having innumerable tortuous paths to allow for intimate mixing of the foamable solution and air. Although material making up the porous member can be fairly resilient, a more or less noncompressible or rigid material is generally preferred for optimum uniformity of foam due to reduced compression of the porous channels within the porous material. Noncompressible porous materials may be made from foraminous volcanic glass material, sintered glass of the type used in filters, or noncompressible plastics such as porous polyethylene, polypropylene, nylon, rayon, etc.

For optimum operation of the foam dispenser the porosity and/or rigidity of the porous member is very important. More specifically the porous member will be receiving air or foamable solution directly from the container depending on the position of the container at time of pressurization. Consequently the porosity should be such to pass either air or liquid through the porous member at a uniform and optimum rate for mixing with little or no leakage of foamable solution when the container is upended prior to pressurization. The rigid porous materials operate more effectively because they are not subject to significant compressibility which tends to reduce fluid passage and particularly the passage of the foamable solution as opposed to air. In certain instances it may be desirable to design the porous member to optimize the foam production in a certain container position. For example, the porous member could be designed for optimum foam production when foamable solution is being forced through the porous member such as would be the case when the container is inverted.

The conduit connecting the foamable solution or air (depending on container position) with the porous member may be composed of any suitable material which is compatible with the foamable solution and may be of any cross-sectional shape such as round, square and the like. It is generally preferred that the conduit extend through the porous member but it is also obvious that the device will still operate in the manner described even though the conduit does not extend completely through the porous member as long as the distance between the conduit opening leading to the discharge area and the upper surface of the porous member is not so great to substantially inhibit the movement of air returning to the unit.

The container proper may be constructed of any material capable of containing the foamable material and air. Generally the pressure used to force the air and foamable solution together as described will result from manually squeezing the container. In this instance the container material preferred would be that which is flexible and elastic such as many of the presently known plastics.

While preferred embodiments of the present invention have been shown and described, it will be obvious to those skilled in the art that changes and modifications may be made therein without departing from the invention in its broader aspects.

What is claimed is:

1. A foam dispensing device comprising, in combination, a a flexible container for holding a foamable liquid and air having a discharge port at its upper end, b a porous member separating the area adjacent said discharge port and the inside portion of said container, c a conduit means extending longitudinally at least substantially through said porous member said conduit means including an opening communicating with the inside portion of said container, an opening communicating with the porous member and an air re-entry, and d a directional valve system associated with the air re-entry for substantially precluding outward fluid flow through the air re-entry and directing fluid from inside the container through the conduit means into the porous member through said opening communicating with said porous member when the container is pressurized.

2. The foam dispenser according to claim 1 wherein e the porous member is substantially noncompressible.

3. The foam dispenser according to claim 1 wherein e the directional valve system includes movable valve means actuated during depressurization of the container to permit rapid air re-entry into the container through the air re-entry.

4. The foam dispenser according to claim 1 wherein e the directional valve system includes movable valve means actuated during pressurization to direct one fluid from the conduit means into the porous member while the other fluid is being forced directly into the porous member from the inside of said container; one of said fluids being a foamable liquid and the other of said fluids being air.

5. The foam dispenser according to claim 4 wherein f the movable valve means includes a ballcheck operatively engageable with projection means situated on the inside of said conduit means to permit air flow around said ballcheck when the ballcheck is substantially in contact with said projection means.

6. The foam dispenser according to claim 1 wherein e the air re-entry is disposed outwardly of the opening communicating with the porous member.

7. A foam dispensing device comprising, in combination, a a flexible container for holding a foamable liquid and air having a discharge port at its upper end, b a porous member separating the area adjacent said discharge port and the inside portion of said container, c a conduit means extending substantially between said porous member and the inside portion ot the container said conduit means including an opening within the inside portion of said container, an opening communicating with the porous member, and an air re-entry, and d a directional valve system associated with the air re-entry for substantially precluding outward fluid flow through the air re-entry and directing one of said fluids from inside the container through the conduit means into the porous member through said opening communicating with said porous member, while the other of said fluids is directed into said porous member by a different path, when the container is pressurized.

8. A foam dispenser according to claim 7 wherein e the conduit means includes an elongate member extending into the porous member and having at least one side opening providing the opening communicating with the porous member, and an outer open end providing the air re-entry, and f the valve system includes a ballcheck operatively engageable with projection means situated on the inside of said conduit member to permit air flow around said ballcheck when the ballcheck is substantially in contact with said projection means, said projection means being disposed between said side and end openings.

* * * * *